United States Patent [19]

Heuker of Hoek et al.

[11] Patent Number: 4,573,043

[45] Date of Patent: Feb. 25, 1986

[54] SAFE GUARDED LOCKABLE CONTAINER, PARTICULARLY FOR TRANSPORTING MONEY AND SECURITIES

[75] Inventors: Johannes G. J. Heuker of Hoek, Hillegom; Cornelis J. Clement, Dordrecht; Ernst M. van der Lee, Reeuwijk, all of Netherlands

[73] Assignee: Captor Holding B.V., The Hague, Netherlands

[21] Appl. No.: 505,987

[22] Filed: Jun. 20, 1983

[51] Int. Cl.[4] ..... G08B 13/14

[52] U.S. Cl. ..... 340/571; 340/542; 340/543

[58] Field of Search ..... 340/542, 543, 571, 309.15; 109/21, 31, 38, 39; 220/20; 368/10, 12, 108, 109

[56] References Cited

U.S. PATENT DOCUMENTS 3,851,602 12/1974 Lamping ..... 109/31 X
4,267,553 5/1981 Vogelsanger et al. ..... 340/571
4,305,062 12/1981 Hogg, Jr. et al. ..... 340/309.15

FOREIGN PATENT DOCUMENTS 8102493 12/1982 Netherlands ..... 340/542

*Primary Examiner*—James L. Rowland
*Assistant Examiner*—Chi K. Lau
*Attorney, Agent, or Firm*—Guy E. Matthews

[57] ABSTRACT

Alarm producing apparatus for safeguarding a container carried by a messenger including a time countdown system and a status detection system assuring that container and messenger remain together. Countdown time is set sufficiently to allow normal delivery of container by messenger. Smoke, sound and/or visual signals are triggered by separating container from messenger or by excess time lapse occurring during delivery of container by messenger.

25 Claims, 4 Drawing Figures

SAFE GUARDED LOCKABLE CONTAINER, PARTICULARLY FOR TRANSPORTING MONEY AND SECURITIES

FIELD OF THE INVENTION

Safeguarded lockable container, particularly case for transporting money and securities.

BACKGROUND OF THE INVENTION

The invention relates to a safeguarded, lockable container.

The invention has for its object to improve the safeguarding of the transport of, for example, money and values, in particular the transport of money and values in a case which has to be brought, for example, by a messenger from an armoured car to, for example, a bank.

According to a first aspect of the invention there is to this end provided a container of the kind set forth in the preamble which is characterized in that it comprises a microprocessor device having at least one microprocessor, a memory member connected thereto in which a safeguarding programme is stored, and input/output member connected to the microprocessor and a tempering member connected to the microprocessor and to the input/output member for generating a first temper signal having the system frequency of a microprocessor, a second temper signal having a given frequency for scanning the inputs of the input/output member and a third temper signal having a frequency which fixes a given count-down time decrement, a plurality of status guarding members connected to respective inputs of the input/output member and a plurality of alarm producers connected to respective outputs of the input/output member, in which the output signal of at least one of the status guarding members signals whether the container is safely locked and under the control of the safeguarding programme and during continuous signalling of the safely locked state of the container the microprocessor diminishes a period of time defined in the safeguarding programme by the count-down time decrements and as soon as or after the count-down has reached the zero instant or as soon as at least one of the status guarding members signals that the container gets into an unsafe state at least one output of the input/output member connected to a respective alarm producer is actuated so that this alarm producer is energized, whilst without actuating anyone of the outputs of the input/output member connected to a respective alarm producer the microprocessor stops counting down after the container is opened in accordance with the safeguarding programme.

Instead of counting down the basic period of time fixed in the safeguarding programme by the countdown decrements determined by the frequency of the third temper signal with the associated alarm generation at a zero instant, a zero instant may, of course, be used as a start for counting up by count-up time increments determined by the frequency of the third temper signal with the associated alarm generation when a period of time fixed in the safeguarding programme is counted up. However, for several reasons counting down by countdown time decrements is preferred, inter alia because counting down to a zero instant (00:00) excludes any ambiguity with regard to the period of time or transit time fixed in the safeguarding programme, which may be a standard as will be described more fully hereinafter, or may be keyed or written by the messenger.

According to a second aspect the invention provides a container of the kind set forth in a preamble which is characterized in that it comprises a locking member for locking the container in order to generate a locking signal in the locked state of the container, a time setting member for generating a time signal which is representative of a given period of time, a time-base member for producing a time-base signal of a given frequency, a time count-down member connected to the locking member, to the time-base member and to the time setting member in order to count down, after reception of the locking signal, from the period of time determined by the time setting signal by time decrements determined by the time-base signal as long as the time countdown member continues receiving the locking signal and an alarm member for producing al alarm signal when or after the time count-down member has counted down to a zero instant.

BRIEF DESCRIPTION OF THE DRAWINGS

The invention will now be explained in detail with reference to the drawing, in which.

DETAILED DESCRIPTION OF THE INVENTION

In a first, practical embodiment of the invention the container employed as a case is provided with a plurality of display elements, for example the well-known red light emitting, 7-segment display elements and/or liquid crystal display elements, as the case may be, an additional lock switch for selecting the form of alarm and/or signaling and three push-button switches for setting each a period of time to be discussed hereinafter, whilst furthermore the container may be equipped with a chain with a wrist band and inside with a wire loop and a magnetic contact to constitute a detection loop to be described later. Moreover, for safeguarding the case in this embodiment a so-called smoke cartridge was chosen.

Figure 1:
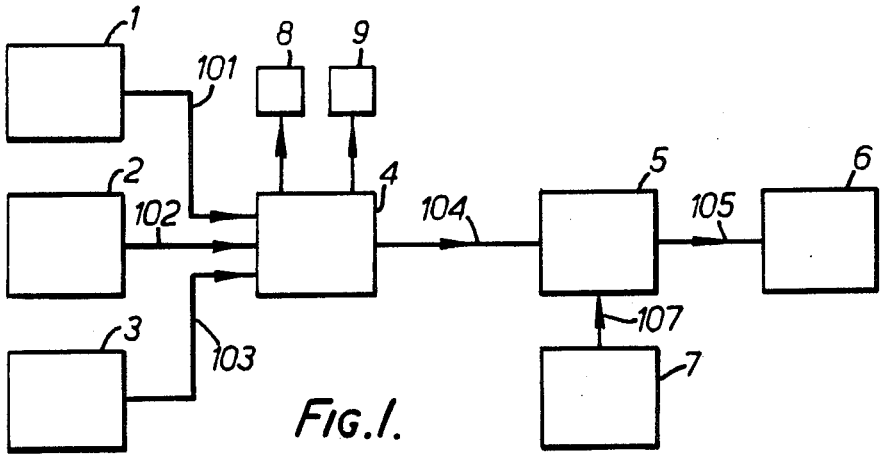
FIG. 1 is a block diagram of electronic and electric members to be arranged in or on the container.

Referring to FIG. 1 reference numeral 1 designates a locking member, reference numeral 2 a time setting member and reference numeral 3 a time-base member. The output signal of the locking member, the time-setting member as well as of the time-base member is applied to a countdown member designated by reference numeral 4, the output signal of the locking member 1 being designated by reference numeral 101, the output signal of the time-setting member by reference numeral 102 and the output signal of the time-base member by reference numeral 103. The output signal of the time count-down member 4 is applied to an alarm member referenced 5 and is designated by reference numeral 104. The output signal of the alarm signal 5 referenced 105, termed the alarm signal hereinafter, is applied, in one embodiment of the container is accordance with the invention, to a member for energizing a smoke cartridge designated by reference numeral 6. In this embodiment of the invention the alarm member is connected to the aforesaid detection loop designated schematically by reference numeral 7, the output signal of which is referenced 107.

The locking member 1 may be provided with a lock having at least one electric switching element to permit of locking the container and of generating a locking signal 101 in the locked state of the container. This signal is preferably a bivalent signal, which may be high when the container is locked, which may be represented by a logic 1, whereas with the above assumptions it represents a logic 0 when the container is not locked. When the time count-down member 4 receives a logic 1, it will know that the container is locked, whereas when the time countdown member 4 receives a logic 0, it will know that the container is not locked.

Obviously the lock provided with at least one electric or electronic switching element, for example, a contact lock has to be accessible externally of the container in order to permit the locking the container with a key. There may furthermore be provided an additional key switch to select a form of alarm, for example, a smoke cartridge alone or a combination of, for example, a smoke cartridge and a sirene signal.

The time-base member 3 produces a time-base signal 103, which may be an A.C. signal of, for example, 1 Hz so that, as will be discussed later, the time count-down member can count down in time decrements of 1 second.

The time setting member 2 generates a time signal 102, which is representative of a given period of time. It is important to note that time-setting member comprises a plurality of switching elements, which are accessible, like the contact lock of the locking member 1, externally of the container in order to set occasionally given lapse of time with the aid of, for example, one switching element, for example, push-buttons, one deactivating the others, or given combinations of switching elements. In the first case a given lapse of time is allotted to each switching element. In a preferred embodiment of the time-setting member 2 the time signal 102 depends on only one depressed key provided on the container. By first push-button a lapse of time of, for example, 5 minutes can be set, by the second push-button a lapse of time of 10 minutes and by the third push-button a lapse of time of 15 minutes. Preferably the time signal 102 is a binary code of a given number of bits, in the case of the three push-buttons, for example, 2 bits, in which case, for example, the binary code 0, 1 corresponds to a lapse of time of 5 minutes, the binary code 1, 0 to a lapse of time of 10 minutes and the binary code 11 to a lapse of time of 15 minutes. Said binary codes can be simply produced by means of three flipflops connected to one another and to the pushbuttons, which will be discussed hereinbelow with reference to FIG. 2.

The time count-down member 4 receives the locking signal, which is a bivalent signal, the time signal 102 being a binary code and the time-base signal 103, which is an alternating-current signal of a frequency of 1 Hz. Starting from the period of time set by the time-setting member, for example, 5 minutes, the time count-down member counts down in time decrements of 1 second so that counting down is true to time. Of course, time counting down may be performed, as al alternative, in a manner not true to time. Moreover, the time signal 102 may be an analogue signal rather than a digital signal.

The time count-down member 4 starts counting down only when the signal 101 is at the logic level 1, which is representative of the locked state of the container. Then the time count-down member counts down starting from the period of time set by the time-setting member by time decrements of 1 second until an instant zero. For this purpose the time count-down member may be equipped with count-down circuits connected in a series, one for seconds, one for minutes any one for tens of minutes. When adjusting the time count-down circuits of the period of time with the aid of the time signal 102 carry signals will flow from one time count-down circuit to the other, whereas during counting down initiated by the locking member 1 borrow signals will be generated in the opposite sense. When the time count-down member has counted down to the zero instant, it will generate a signal 104 which is representative of the termination of the subtraction.

The time count-down member 4 may be connected to a display member 8 comprising, for example, four display elements so that a set period of time up to 60 minutes can be displayed. During counting down the time count-down member 4 will cause the display member to advance every one second so that after a set period of time of 15.00 after one time decrement 14.59 is indicated and so on. In this way the count-down is visualized. The time count-down member 4 may furthermore be connected to a display member 9 for rendering the count-down audiable, for example, by a tick of a loudspeaker at every time decrement. The display elements have, of course, to be arranged on the container and this also applies to any loudspeaker or buzzer used for an audible count-down.

The alarm member 5 may be designed so that immediately after the reception of the alarm signal 104 from the time count-down member 4 or of an output signal 107 being representative of an interruption of the detection loop a signal 105 is produced which, in this embodiment, energizes a member 6 for breaking up the smoke cartridge. It should be noted that the reception of only one of the signals 104 or 107 is a primary condition for the ignition of a smoke cartridge so that the detection loop operates independently of the operation or the non-operation of the time count-down member. The detection loop may comprise a chain on the case and a wire loop and a magnet contact inside the case.

In a further embodiment of the invention the alarm member 5 is provided with an alarm delay circuit which becomes operative when the time count-down member 4 has counted down to the zero instant and provided the locking member 1 has not stopped generating the locking signal, that is to say, the case is still locked to produce an audible and/or visible signal, for example, a persistent buzzer signal for a given delay period, for example, 60 seconds, whilst when said delay period has elapsed, the alarm signal is as yet produced if within said 60 seconds the alarm condition has not been eliminated. Consequently when within said 60 seconds the lock of the locking member 1 is opened in the normal way the smoke cartridge will not be ignited.

Most blocks of FIG. 1 will now be described with reference to FIG. 2, which illustrates a practical embodiment.

Figure 2:
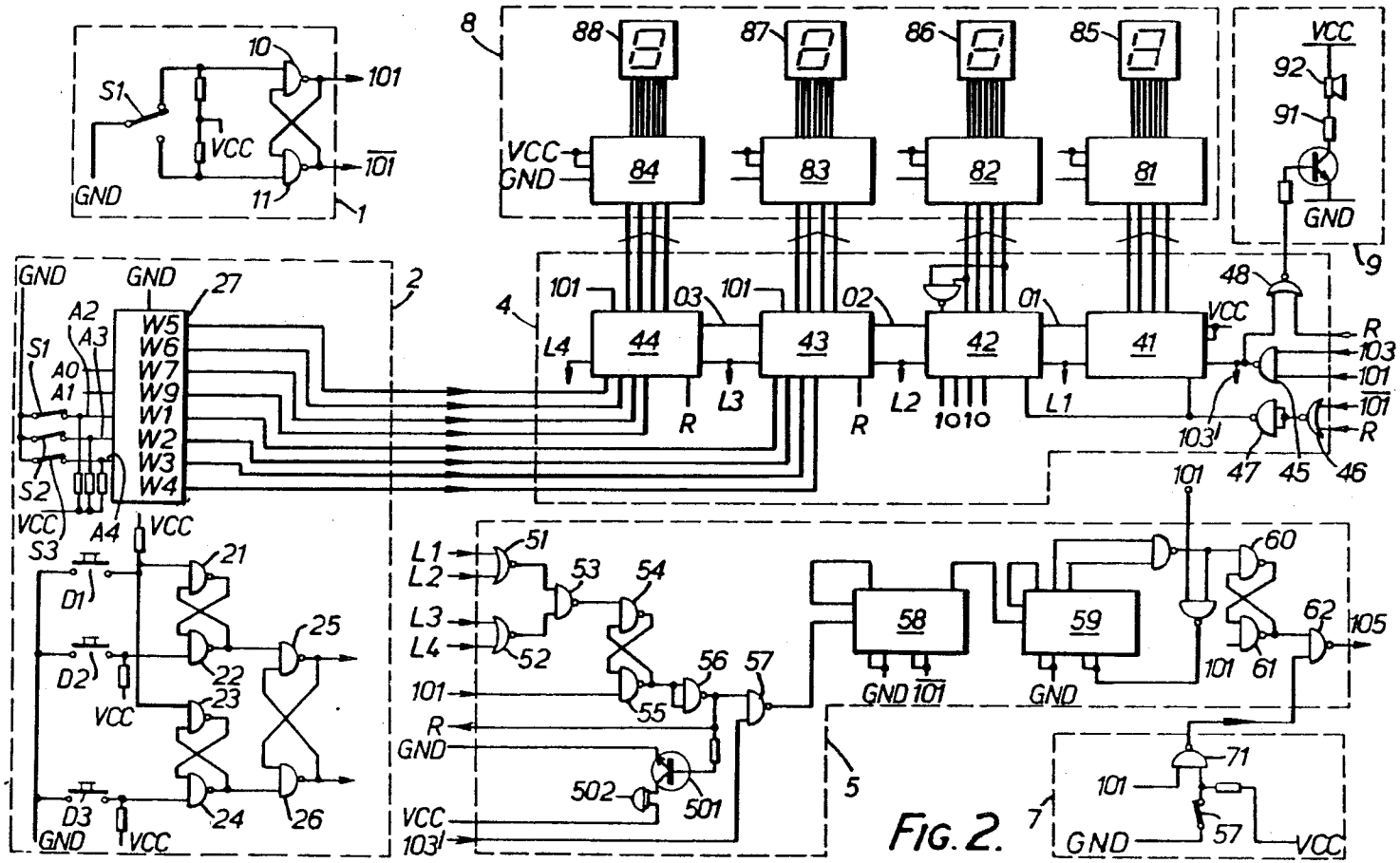
FIG. 2 is a detailed circuit diagram of the blocks of FIG. 1.

Referring to FIG. 2, VCC represents a positive feed voltage and GND potential. The circuit elements associated with one and the same block are surrounded by a dot-and-dash outline having the same 35 reference numeral as used for a corresponding block in FIG. 1.

As shown in FIG. 2, the locking member 1 comprises a circuit element S1, which co-operates with a lock (not shown) and a flipflop circuit formed by the NAND gates 10 and 11. The output signal of the NAND gate 10 is the locking signal 101 and the output signal of the NAND gate 11 is the logic inverse signal thereof, indicated by 101. When the case is locked, the lid 101 is in the logic state 1.

The time-setting member 2 of FIG. 2 comprises push-buttons D1, D2 and D3 for setting by push-button D1 a given time T, by push-button D2 twice said time: 2T and by push-button D3 three times said period: 3T. As is shown the three push-buttons D1 and D3 are connected to three flipflops formed by the NAND gates, 21, 22, the NAND gates 23, 24 and the NAND gates 25, 26. The output of NAND gate 25 is the least significant bit of the binary code obtained by the push-buttons D1 to D3 and designated by A0. The output of NAND gate 26 is indicated by A1 and it is the least significant but last but one of the binary code AO in the next binary member. The 2-bit code A0, A1 of the flipflop formed by the NAND gates 25 and 26y is applied to the less significant bit address lines of the programmable dead memory 27. The more significant bit (A2, A3, A4) address lines of the programmable dead memory 27 are set by the circuit elements S1 to S3. In the preferred embodiment shown in FIG. 2 the three more significant bit address lines of the programmable dead memory 27 are, therefore, internally present, whereas the two less significant bit address lines of the programmable dead memory 27 are set externally by means of the push-buttons D1 to D3.

The time count-down member of FIG. 2 comprises the cascade-connected time count-down elements 41 to 44. By the write lines W1 to W4 of the programmable dead memory 27 the minutes are written in the time count-down element 43 and by the write lines W5 to W9 the tens of minutes are written in the time count-down element 44. To the inputs of NAND gate 45 are fed both the time-base signal 103 and the locking signal 101 so that when the case is locked, the time-base signal is admitted to the first count-down element 41, which is indicated by 103' so that after locking the case on the basis of the period of time set by the pushbuttons D1 to D3 the time count-down element 41 starts counting down by time decrements of 1 second, whilst the time count-down element 42 counts tens of seconds. Between the count-down elements 41 to 44 carry signals and borrow signals indicated by 01 to 03 to L1 to L4 are transferred.

The count-down elements 41 to 44 have a BCD output which is converted by the coding elements 81 to 84 into 7-segment code outputs for the respective display elements 85, 86, 87 and 88. The audible display member 9 is formed by a loudspeaker 92 driven by a transistor 91. Reference character R designates a reset signal for holding the time count-down member 4 in the zero state when it has counted down to the zero instant, said reset signal R being generated by the alarm member. The NOR gate 46 and the NAND gate 47 connected as an inverter of the count-down member 4 serve to hold the count-down elements 41 to 44 in a reset state, when either the reset signal R is applied thereto or a signal 101 is in the logic state 1, which is characteristic of the fact that the case is not locked. The NOR gate 48 serves to allow the passed time-base signal 104' to pass as long as the count-down elements 41 to 44 are not maintained in the reset state.

Referring to FIG. 2, the borrow signals L1 to L4 of the count-down elements 41 to 44 are applied to NOR gates 51, 52 of the alarm member 5, the output of said NOR gates being fed to a NAND gate 53, the output of which together with the locking signal 101 of the locking member being fed to a flipflop formed by the NAND gates 54 and 55, the output of NAND gate 55 being connected to the inverter NAND gate 56, which generates the aforesaid reset signal R. In fact, the circuitry formed by the gates 51 to 56 is an alarm identifying circuit. The reset signal R is also applied to a NAND gate 57, which allows the time-base signal 103 and 103' passed by the NAND gate 45 to pass provided the signal 101 is in the logic state 1. The reset signal R is furthermore applied to a buzzer 502 driven by a transistor 501 to actuate the buzzer when the reset state is reached, that is to say, at the zero instant of the time count-down member. The output signal of the NAND gate 57 is fed to the 60-divider counters 58 and 59. After 60 seconds the flipflop formed by the NAND gates 60 and 61 is changed over, upon which the NAND gate 62 generates the alarm signal 105 and will continue generating the same. An input of NAND gate 62 is furthermore connected to the detection loop 7, which operates only when the locking signal 101 is fed thereto owing to the NAND gate 71. The detection loop proper is represented by the normally closed switch 57. With the aid of an additional gate at the gate 71 it can be ensured that in the discontinuous state of the detection loop or the safeguard the latter cannot be switched on.

This embodiment of the safeguarded, lockable container in accordance with the invention is used as follows: When the case is open, the desired time can be chosen by means of the push-buttons, after which the cassette can be placed in the container and the wrist band can be put on. The last manipulation is locking the container, which automatically starts the safeguard of the container. The display members show the count-down of the time, whilst in addition a tick can be heard, which means that the safeguarding device operates satisfactorily. If on the way the container is robbed, the chain of the detection loop is drawn out of the container and the smoke cartridge will be activated. The same occurs when the container is mechanically damaged. The smoke cartridge is also activated when switching off is not again performed within the set time on the understanding that after the termination of the set time 60 seconds are still available to switch off. During these last 60 seconds a signal, preferably a continuous buzzer signal will be audible.

The foregoing embodiments described with reference to FIGS. 1 and 2 of the safeguarded, lockable container in accordance with the invention, or at least the electronic safeguard thereof, are based on discrete, logic subassemblies. However, in accordance with a second aspect of the invention a microprocessor device is employed instead, the quality of the protection can be further improved, which will be illustrated in the following, detailed description of this aspect of the invention with reference to FIGS. 2 and 3 of the drawing.

Figure 3:
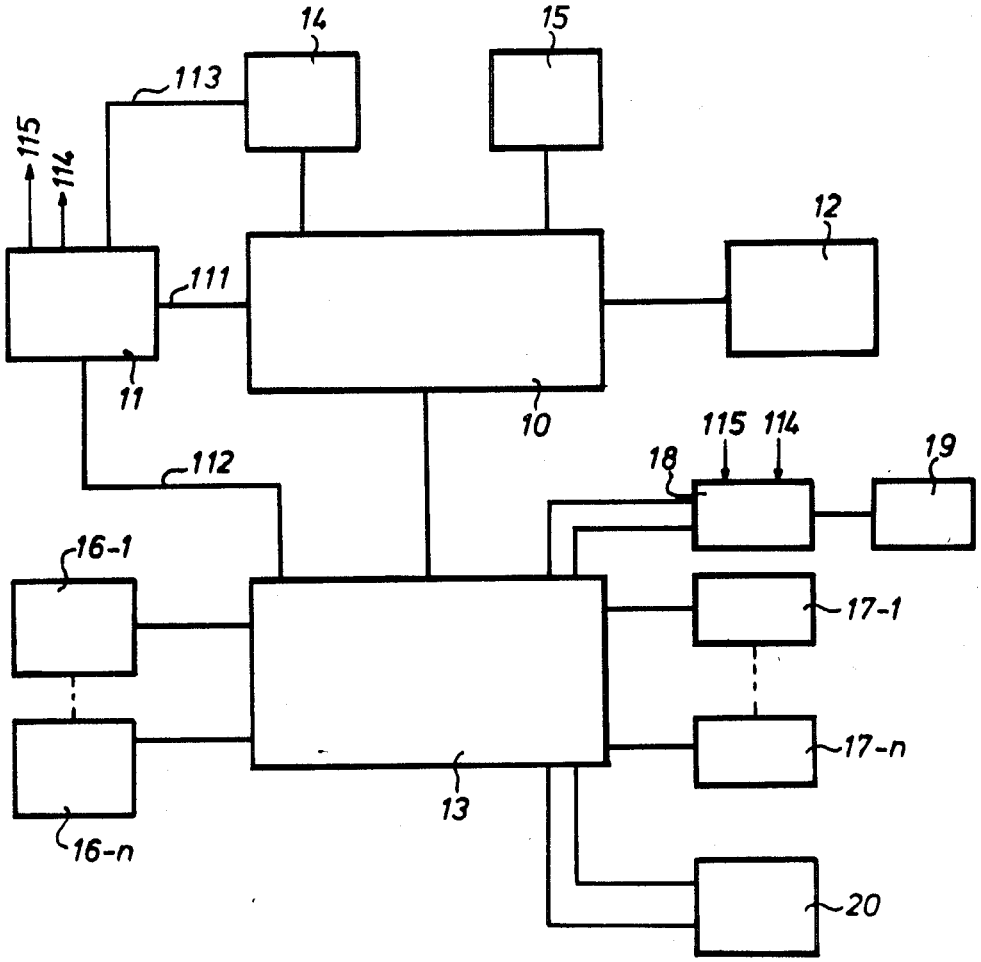
FIG. 3 is a simplified block diagram of the electronic safeguarding device to be arranged in or on the container with the use of a microprocessor and FIG. 4 shows in a drastically simplified form the design of a case carrying securities.

Referring to FIG. 3 reference numeral 10 designates a microprocessor, for example, of the type 6502. To the microprocessor 10 is connected a memory member 12 comprising at least one dead memory (EPROM), for example, of the type 2732 and at least one freely accessible memory (RAM) of, for example, the type 6116. In the dead memory of the memory number 12 is stored an interactive basic safeguard programme, which will be referred to later. To the microprocessor 10 is furthermore connected an input/output member 13, for example, of the type 6520. To the microprocessor 10 and the input/output member 13 is connected a tempering member 11 inter alia for producing a first temper signal 111 of the system frequency, in this case about 1 MHz of the microprocessor and a second temper signal 112 of a given frequency, for example, 60 Hz in order to scan every 1/60th second all inputs of the input/output member 13 by means of an interruption/demand routine (IRQ routine). The inputs of the input/output member 13 have connected to them a plurality of status monitoring members 16*i* (i=2... n) in order to signal to the microprocessor, as will be described later in this description, whether the container is safely locked, efforts are made to rob the container or to open it unauthorized or the container is not opened in accordance with the safeguarding programme. A number of the outputs of the input/output member 13 are connected to a number of alarm producers 17*i* (i=1... n), for example, a sirene or a smoke cartridge. A further number of the outputs are connected to a sound producer 19, for example, a buzzer, by means of an addressable selection member 18, for example, an analogue multiplexer as well as of a locking member 20, which may be formed by a plurality of solenoids for locking the safety lock to be described hereinafter and the money or security cassette also to be described hereinafter. To the microprocessor are furthermore connected a keyboard 14 and a visual display device 15. The keyboard is preferably a hexadecimal keyboard having 16 keys (O to F) whilst the visual display member 15 is preferably a liquid crystal display device, in which the characters are built up by dots in a matrix preferably comprising two lines of 16 characters. The tempering member 11 generates a further signal 113 of a frequency of, for example, about 1 kHz for rattle-free fixation of the keyboard 14. Finally the tempering member produces the temper signals 114 and 115 of, for example, 1 Hz and 7.5 Hz respectively, the signal of the frequency of 1 Hz determining the count-down time decrements to be described later (or analogue count-up time increments less preferred in a variant which will not be discussed further), whilst the latter temper signals are fed to the analogue multiplexer 18.

It is emphasized here that the block diagram of FIG. 3 described above is drastically simplified. For example, the input and output buffers for the inputs and outputs respectively of the input/output member 13 as well as, for example, the coder for the keyboard and so on are omitted.

Figure 4:
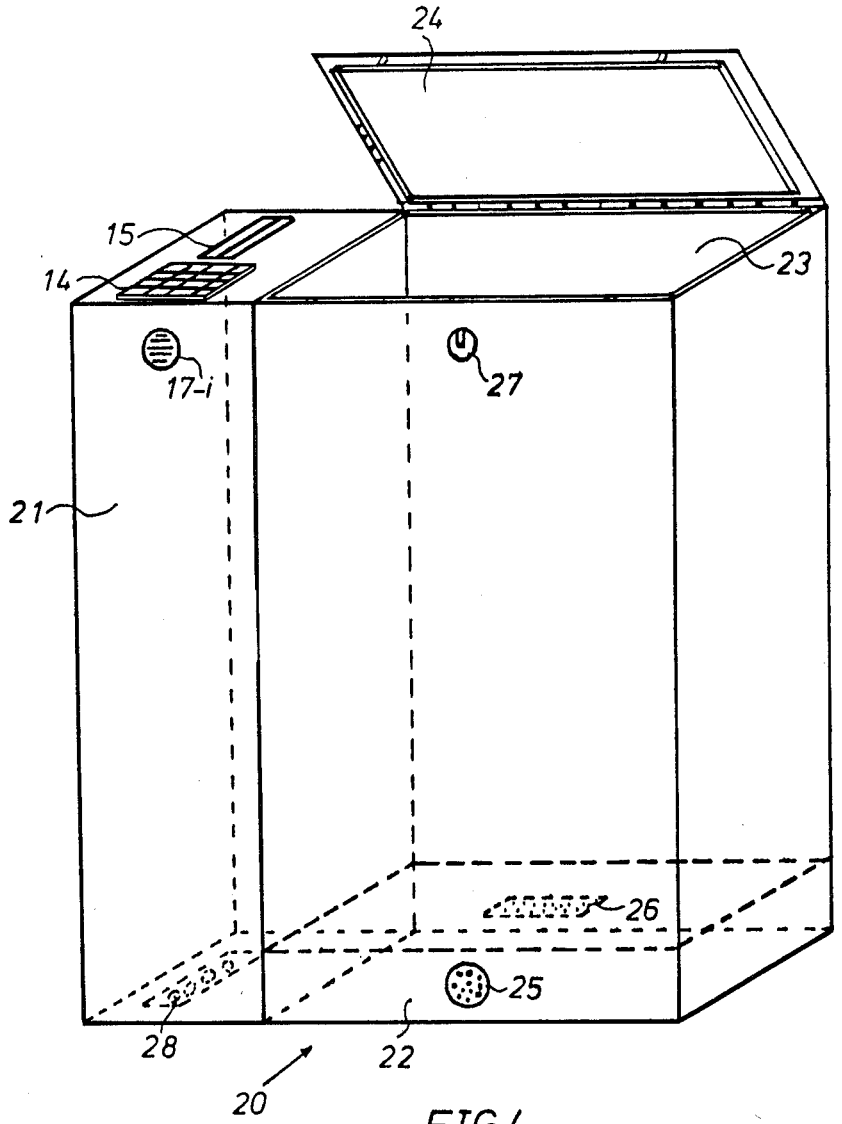

FIG. 4 shows the container, particularly the transport case in its most essential form and provided with some components already referred to in the discussion of the block diagram of the electronic safety device. The container is designated by reference numeral 20. Reference numeral 21 designates the electronic compartment, 22 the smoke cartridge compartment and 23 the transport compartment. The electronic compartment 21 accommodates the major part of the electronic safety device, for example, the sirene 17-*i*, the keyboard 14 and the visual display member 15. Moreover, the electronic compartment may be provided on the underside with charging contacts 28 for an accumulator charger supplying the energy for the electronic safety device. The transport compartment 23 receives the money or security cassette and it is closed by a lid 24 and locked by means of a safety lock 27 shown quite schematically. The smoke cartridge compartment accommodates the smoke cartridges and the associated ignition resistors. Reference numeral 25 designates a smoke blowing opening and reference numeral 26 designates an opening for blowing smoke inwards, a particular for blowing smoke out of the smoke cartridge compartment into the cassette placed in the transport compartment, in which case, of course, the bottom of the cassette should have a corresponding opening.

Referring back to FIG. 3, a status monitoring member 16 may have one or more lid contacts in order to emit, when the lid 24 is closed, a confirming signal by means of the input/output member 13 to the microprocessor 10. A further status monitoring member 16 may comprise at least one electric contact of the safety lock 27 to signal to the microprocessor whether the lock is in the closed state. When the two aforesaid status monitoring members 16 emit a conformative signal, the container with the lid 24 is locked by the safety lock 27. Of course, safeguarding the container only has sense when there is anything to be safeguarded i.e. when a cassette containing money or other values or the like is placed in the container. For this reason there is provided a third status monitoring member 16 comprising a detector, for example, a microswitch to detect whether the cassette is put in. Where hereinafter reference is made to safe locking of the container this is to be understood to mean that the output signals of the aforesaid three status monitoring members 16 are all conformative, which implies that the cassette is present and the lid is locked on the container by means of the safety lock.

A further status monitoring member 16 comprises a conductor pattern which co-operates with the externally accessible walls of the container in order to produce a conformative signal upon the interruption of said conductor pattern. In a practical embodiment the conductor pattern may be arranged on the inner side of the externally accessible walls of the container or printed wiring may be provided on the same side of the walls, in which case, of course, the partial conductor patterns have to be relatively connected. The latter status monitoring member 16 provides a safeguard, for example, when the container should be pierced.

As stated above, the container, in particular a value transport case, is carried by a person. In order to enable detection whether the distance between this person and the transport case becomes too large, for example, in the case of robbery, this person is equipped with a preferably simple transmitter (not shown) emitting a constant carrier wave signal, whilst a status monitoring member 16 comprises a receiver supplying a denying signal as long as the carrier wave signal is received. If however, the distance between the transmitter and the receiver becomes too large, the status monitoring member concerned will supply a confirmative signal so that the microprocessor 10 will signal that the distance between the messenger and the value transport case is inadmissibly large. Otherwise many other status monitoring members may be used, for example, a voltage monitor, for example, in the form of a sensitive comparator to indicate when the accumulator voltage drops below an impermissible value. The aforesaid charging contacts 22 can then be used to charge the accumulator(s) before starting the transport.

A practical embodiment comprises three alarm producers 17-i to wit an electronic sirene, a smoke cartridge applying an unerasable or hardly erasable colour to the contents of the cassette in the container and a smoke cartridge for blowing out signalling smoke. Otherwise also the alarm producers may be chosen differently, for example, an optical eye-catching display member.

In a practical embodiment the locking member 20 comprises two solenoids, one for the safety lock and one for the cassette. After the container is safely locked, the safety locked and the cassette are bolted within a given short time of, for example, 2 seconds; this bolted state can be obviated only when the container is opened in accordance with the safeguarding programme, which means, as will be discussed hereinafter, that the safety lock is opened with a key and a given control-code is tapped. Assuming the transport container has to be brought by a messenger from a money transport car to a bank, the messenger can safely lock the container in the car and, whilst leaving his key and the specific control-code apart from the standard or emergency control-code to be described hereinafter in his memory, he can carry the transport container to the bank where the same key is available so that by means of the latter key and the said control-code the transport container can be opened in accordance with the safeguarding programme.

The sound producer and in a practical case the buzzer 19 serves the buzzer 19 serves to render the count-down audible as will be discussed hereinafter; this is otherwise analogue to the count-down in the container having discrete logic circuits. There is furthermore indicated the delay time of, for example, 60 Hz with a variation of the frequency of the driving signal to the buzzer of, for example, 1 Hz to 7.5 Hz, that is to say, the frequences of the temper signals 114 and 115 of the tempering member 11.

Hereinbelow the operation as well as the use of a safeguarded, lockable container provided with a microprocessor will be described more fully.

After the connection of the safeguarding device, particularly the microprocessor device comprising at least the microprocessor, the initializing phase starts. In this initial phase first the microprocessor and the input-/output member are initialized after which the memory member, in particular the freely accessible memory and dead memory are tested in order of succession. In a practical embodiment the accomplishment of the initialization of the microprocessor and the input/output member is intimated to the operator by the energization of the buzzer 19 by the 1 Hz temper signal 114 of the tempering member 11 by means of the analogue multiplexer 18. When the freely accessible memory is found to be correct, the 7.5 Hz temper signal is allowed to pass via the analogue multiplexer 18 to the buzzer 19, whereas in the opposite case the analogue multiplexer 18 supplies a direct-current signal to the buzzer 19, which will thus sound continuously. If the freely accessible memory is correct and if thereafter also the dead memory is correct, the analogue multiplexer 18 switches off the buzzer, whereas in the opposite case the buzzer 19 produces an uninterrupted sound. Subsequently the initialization is performed in accordance with the programme, particularly with respect to the several variables such as the standard transit or transport time, as the case may be, the delay time and the standard control-code, which will be discussed later.

After the initializating phase briefly described above, the safeguarding devices reaches the so-called first user phase in which the condition of the container or transport case is a passive one and a number of functions can be carried into effect by means of the keyboard as follows. The first function by which the safeguarding device gets into the first user phase is that in which the conditions of the status monitoring member **16-*i* are visible on the visual display member 15**. Only by this first function of the first user phase the container or transport case can pass to the active condition or else the second user phase.

When the container is not brought in the manner to be described hereinafter into the second user phase, the safeguarding device goes over to a second function in which by means of the keyboard the standard control-code, which is preferably the same for all transport cases, can be replaced by a specific control-code for the messenger concerned, which is required to put an active transport case into the passive state. This code may comprise at the most six digits and is visible for a short time after its initiation, for example, for 4 seconds on the visual display member.

Then the safeguarding device goes over to a third function in which again with the aid of the keyboard the standard transit time of, for example, 15 minutes, which may again apply to all transport cases, can be changed, in which case the introduction of a zero period of time of, for example, 15 minutes, which may again apply to all transport cases, can be changed, in which case the introduction of a zero period of time or a mininium transit time by programmatic blocking would not be accepted, the same applying to a period of time exceeding the maximum transit time.

By a fourth function, by means of the keyboard, the sirene, the buzzer and the visual display member can be tested for satisfactory operation. By a fifth and sixth funtion, by means of the keyboard, a short explanation of the operation and the use of the transport case can be given line by line on the visual display member in a first and a second language respectively.

By a seventh function a selection can be made with respect to the alarm producers to be actuated, for example, a combination of the sirene and smoke blown to the inside and to the outside or the sirene and only smoke blown to the outside.

Finally the safeguarding device returns to its first function in which, as stated above, the container can be switched to the active state. The safeguarding device becomes active by placing the cassette in the container, by closing the lid, by locking the lid to the container by means of a key and the safety lock, when all status monitoring members give safe signals. The sole function of the keyboard in the second user phase is the change-over of the safeguarding device to the passive state by tapping the control-code. In order to enhance the safe guard the device gets into the passive state only when by means of a different key both the lid and the safety lock are unbolted and the correct control-code is written.

The present specification will now be concentrated on the second user phase, that is to say, the active state of the safeguarding device.

When the safeguarding device is made active, this is directly indicated on the visual display device 15, for example, by the change of the indiction "out" into the indication "on", whilst at the same time there appears the indication of the specific or standard transit time, for example, "15:00". Moreover, the visual display member gives at all times an indication of the condition of the status monitoring members, for example, "fault 3", from which the messenger knows that "fault 3" means that the system voltage for the microprocessor is too low. A further fault may be that the microprocessor has encountered an illegal status and has reset itself, in which case the standard control-code has to be used for switching on the correct passive state of the container. Moreover, at all times the function of the device is indicated, for example, "fO" for the first funtion i.e. the function in which the container can be switched to the active condition.

After the change-over of the container to the active state and when the indication "On" and "15:00" appear on the visual display member, the buzzer is energized once per second and the transit time indication synchronously steps from "15:00" to "14:59" and so forth. The count-down is, therefor, visible and audible. Preferably an alarm delay time is included in the standard safeguarding programme so that when the instant indicated by "00:00" is reached, without the container being switched over to the passive state in accordance with the safeguarding programme, there appears, for example, the indication "fault 5" on the visual display member, whilst the buzzer starts sounding at the sharply penetrating frequency of 7.5 Hz, after which 60 seconds are available to switch the container into the passive state. If within these 60 seconds the container is not opened in accordance with the safeguarding programme, the sirene will sound, colouring smoke will be blown into the cassette and/or signalling smoke will be blown out in accordance with the selected programmed alarm producer. As the case may be the count-down of the alarm delay time may also be visualized on the visual display member.

If on the contrary within the transit time the control-code is written and the safety lock is opened, not any alarm producer will be energized. Apart from the possibility of direct unbolting of the cassette by the control-code, an alternative possibility is to unbolt the cassette only afterwards by means of the keyboard.

With regard to the illegal state of the microprocessor a so called "watchdog pulse" is used in conjunction with a monostable multivibrator, which receives a pulse via an output of the input/out device. If this pulse is too slow or if it is lacking, the monostable multivibrator applies a pulse to the NMI input of the microprocessor, which is thus reset and the indicators are freshed up.

The visual display device also indicated as a fault function when a smoke cartridge is activated or the sirene is activated so that, for example, if the sirene has sounded, but not smoke is blown out, it can be assessed whether the safeguard device itself has failed or whether energization of the output concerned of the input/output device has failed to ignite a smoke cartridge.

When the distance between the messenger and the transport case becomes too large, the buzzer will emit, for example, a continuous tone and if said distance is not reduced to an extent such that the status monitoring members signal to the microprocessor that the transmitter-receiver contact is restored, the selected alarm producers are actuated after a given period of time, for example, 30 seconds, which will also be the case though without delay when, for example, the container is pierced. As an alternative, instead of using a transmitter/receiver circuit, a detection loop may be used as in the embodiments first described, said loop being fastened to the wrist chain so that the messenger is connected with the container. The interruption of the detection loop will also lead to an immediate alarm.

Moreover active touching of the keys of the keyboard can be rendered audible by the buzzer which may sound, for example, for ⅓ second in this case.

In Summary,

The invention is manifest in FIGS. 1 and 4 taken together as one embodiment and in FIGS. 3 and 4 taken together as another embodiment. The essential elements of the invention are common to the embodiments of FIGS. 1 and 3 as hereinafter outlined.

In FIG. 1, there is shown alarm producing apparatus including an alarm signal activating means 5 for producing an activating signal 105 for actuating at least one alarm means 6 in independent response to (1) a zero instant signal 104 received from a time countdown means 4, or (2) a status change signal 107 received from a status detection means 7. The status detection means produces a status change signal 107 at any time a change in status occurs in a condition monitored for the container.

The time countdown means 4 is adapted to proceed to the zero instant signal 104 only when concurrently receiving (1) at least one status locking signal 101 produced by at least one status locking detection means 1 interconnected to monitor the continuing proper condition of the container which was established prior to starting the time countdown means, (2) a time signal 102 produced by a time setting means 2 adapted to activate said time countdown means 4 for a prescribed time period, and (3) a time base signal 103 produced by a time base means 3 adapted to produce a signal of frequency prescribed to cause the time countdown means 4 to count down the time period in decrements of time corresponding to the frequency.

The alarm apparatus is adapted to give no alarm during the prescribed time period unless (1) the countdown means 4 proceeds to the zero instant signal 104 without being stopped by the messenger, or (2) a change in status occurs in at least one of the status detection means 7 as may be caused by a change in the conditions established to assure proper delivery of the container.

FIG. 4 discloses the container 20 which includes a transport compartment 23 with a lid 24 for accommodating a cassette, an electronics compartment 21 for accommodating an essential part of the electronics of said apparatus and a smoke cartridge compartment 22 holding at least one smoke cartridge (not shown). The smoke cartridge compartment has at least one first smoke blowing opening 25 in an outer wall and at least one second smoke blowing opening 26 in the wall between the smoke cartridge compartment and the transport compartment. A security cassette (not shown) having an opening is mounted within the container with the opening in registry with the second smoke blowing opening 26. The container is provided with externally accessible circuit elements 14 for hand manipulation 15 and for visual display. Accumulator charging terminals 28 are provided for external charging of the apparatus.

The apparatus of FIG. 3 operates in combination with the container above described for FIG. 4 and is shown to include alarm producing apparatus including an alarm signal activating means 10, 13 for producing an activating signal for actuating at least one alarm means 17 in independent response to (1) a zero instant signal received from a time countdown means 10, 13, or (2) a status change signal received from a status detection means 16, 13, 10. The status detection means produces a status change signal at any time a change in status occurs in any status monitored for the container.

The time countdown means 10 is adapted to proceed to the zero instant signal only when concurrently receiving (1) at least one status locking signal produced by at least one status locking detection means 20, 13 interconnected to monitor the continuous proper condition of the container established prior to starting the time countdown means, (2) a time signal produced by a time setting means 14, 10 adapted to activate the time countdown means 10 for a prescribed time period, and (3) a time base signal 114 produced by a time base means 11 adapted to produce 18, 13, 10, a signal of frequency prescribed to cause the time countdown means 10 to count down the time period in decrements of time corresponding to the frequency.

The alarm apparatus 17 is adapted to give no alarm during the prescribed time period unless (1) the countdown means 10 proceeds to the zero instant signal without being stopped by the messenger, or (2) a change in status occurs in at least one of the status detection means 16, 13, 10 as may be caused by a change in the condition established to assure proper delivery of the container.

It is of course manifest that the microprocessor 10 incorporates the structure and function, respectively, of the signal activating means, the time countdown means, the time setting means and the time base means.

What is claimed is:

1. Alarm producing apparatus including a lockable container for safeguarding said container when delivered by a messenger, comprising in combination:

(a) alarm signal activating means for producing an activating signal to actuate at least one alarm means in independent response to (1) a zero instant signal received from a time countdown means; or (2) a status change signal received from a status detection means;

(b) said status detection means producing said status change signal at any time a change in status occurs in any respective condition monitored for said container;

(c) said time countdown means adapted to proceed to said zero instant signal only when concurrently receiving (1) at least one status locking signal produced by at least one status locking detection means interconnected to monitor the continuing proper condition of said container established prior to starting said time countdown means; (2) a time signal produced by a time setting means adapted to activate said time countdown means for a prescribed time period; and (3) a time base signal produced by a time base means adapted to produce a signal of frequency prescribed to cause said time countdown means to count down said time period in decrements of time corresponding to said frequency; and (d) said alarm apparatus being adapted to give no alarm during said prescribed time period unless (1) said countdown means proceeds to the zero instant signal without being stopped manually as when delivery is completed; (2) a change in status occurs in at least one of said status detection means as may be caused by a change in conditions established to assure proper delivery of said container.

2. The apparatus of claim 1 wherein said time setting means comprises:

(a) a plurality of circuit elements accessible for manual manipulation with each of said circuit elements having an allotted period of time;

(b) logic circuit means connected to said circuit elements for producing a binary code of a given number of bits dependent on the circuit element which is energized; and (c) a programmable dead memory having at least a number of the address lines connected to the output of said logic circuit means.

3. The apparatus of claim 1 wherein said programmable dead memory contains a number of less significant bit address lines equal to the number of bits of the binary code which are connected to the output of said logic circuit means with the remaining address lines being present by means of circuit elements accessible internally of said container.

4. The apparatus of claim 3 wherein an externally visible display means connected to said countdown means is provided to visualize the countdown.

5. The apparatus of claim 4 wherein an externally audible display means is connected to said time countdown means to provide audible indication of said countdown.

6. The apparatus as claimed in claim 5 wherein said alarm means comprises an alarm delay circuit means which becomes operable when said time countdown means has counted down to a zero instant, providing the said locking means has continued to generate said locking signal, to produce an indication after a prescribed time delay and to produce an alarm signal after termination of said time delay.

7. The apparatus of claim 1 wherein said container comprises:

(a) a transport compartment with a lid for accommodating a cassette;

(b) an electronics compartment for accommodating an essential part of the electronics of said signal producing apparatus;

(c) a smoke cartridge compartment holding at least one smoke cartridge; and (d) said smoke cartridge compartment having at least one first smoke blowing opening in an outer wall and at least one second smoke blowing opening in the wall between said smoke cartridge compartment and said transport compartment.

8. The apparatus of claim 7 wherein said cassette defines an opening which registers with said second smoke blowing opening when said cassette is mounted within said transport compartment.

9. The apparatus of claim 8 wherein said container is provided with externally accessible circuit elements for hand manipulation and for visual display.

10. The apparatus of claim 9 wherein accumulator charging terminals are provided for external charging of said apparatus.

11. The apparatus of claim 1 wherein said status detection means is adapted to detect a discontinuity of an electrical loop which couples said container and said messenger.

12. The apparatus of claim 1 wherein said status locking detection means is connected to assure that said container is initially locked.

13. The apparatus of claim 1 wherein said status detection means comprises a radio receiver adapted to receive a radio signal of prescribed minimum signal strength from a radio transmitter carried by said messenger.

14. The apparatus of claim 1 wherein said alarm signal means comprises an electrically activated smoke cartridge.

15. The apparatus of claim 1 wherein said alarm signal means comprises an electrically operated siren.

16. The alarm signal of claim 1 wherein said alarm signal means comprises visual display means.

17. The apparatus of claim 14 wherein said status detection means is adapted to detect a discontinuity of an electrical loop which couples said said container and said messenger.

18. The apparatus of claim 17 wherein said status locking detection means is connected to assure that said container is initially locked.

19. The apparatus of claim 17 wherein said status detection means comprises a radio receiver adapted to receive a radio signal of prescribed signal strength from a radio transmitter carried by said messenger.

20. The apparatus of claim 11 wherein said smoke signal means comprises an electrically activated smoke cartridge.

21. The apparatus of claim 18 wherein said alarm signal means comprises an electrical operated siren.

22. The alarm signal of claim 19 wherein said alarm signal means comprises visual display means.

23. The apparatus of claim 2 wherein said status detection means is adapted to detect a discontinuity of an electrical loop which couples said container and said messenger.

24. The apparatus of claim 23 wherein said status locking detection means is connected to assure that said container is initially locked.

25. The apparatus of claim 24 wherein said status detection means comprises a radio receiver adapted to receive a radio signal of prescribed signal strength from a radio transmitter carried by said messenger.

* * * * *